US012492029B2

(12) United States Patent
Peutl et al.

(10) Patent No.: US 12,492,029 B2
(45) Date of Patent: Dec. 9, 2025

(54) PACKAGING SYSTEM AND METHOD FOR FEEDING FLAT PACKAGING MATERIALS TO A PACKAGING SYSTEM

(71) Applicant: Krones Aktiengesellschaft, Neutraubling (DE)

(72) Inventors: August Peutl, Woerth an der Donau (DE); Andreas Hack, Osterhofen (DE)

(73) Assignee: Krones Aktiengesellschaft, Neutraubling (DE)

( * ) Notice: Subject to any disclaimer, the term of this patent is extended or adjusted under 35 U.S.C. 154(b) by 0 days.

(21) Appl. No.: 18/839,652

(22) PCT Filed: Dec. 20, 2022

(86) PCT No.: PCT/EP2022/087075
§ 371 (c)(1),
(2) Date: Aug. 19, 2024

(87) PCT Pub. No.: WO2023/160864
PCT Pub. Date: Aug. 31, 2023

(65) Prior Publication Data

US 2025/0153878 A1 May 15, 2025

(30) Foreign Application Priority Data

Feb. 22, 2022 (DE) ..... 10 2022 104 177.8

(51) Int. Cl.
*B65B 43/12* (2006.01)
*B65H 5/00* (2006.01)

(52) U.S. Cl.
CPC ..... *B65B 43/126* (2013.01); *B65H 5/006* (2013.01); *B65H 2301/152* (2013.01)

(58) Field of Classification Search
CPC ..... B65B 43/126; B65B 21/02; B65H 5/006; B65H 2301/152; B65H 2555/30;
(Continued)

(56) References Cited

U.S. PATENT DOCUMENTS 2,707,568 A * 5/1955 Jackson ..... B65H 13/00 414/796.6
6,461,102 B2 * 10/2002 Sting ..... B65H 1/24 414/788.1

(Continued)

FOREIGN PATENT DOCUMENTS

DE 60112194 T2 6/2006
DE 102018212248 A1 2/2020

(Continued)

OTHER PUBLICATIONS

PCT Application: PCT/EP2022/087075 Filed Dec. 20, 2022—International Search Report and Written Opinion dated Apr. 24, 2023.

(Continued)

*Primary Examiner* — Lynn E Schwenning
(74) *Attorney, Agent, or Firm* — Simmons Perrine PLC

(57) ABSTRACT

The invention relates to a packaging system (1) and to a method for using the same. The packaging system (1) comprises a packaging module (2), a first transport device (3) for feeding articles to the packaging module (2) in a first transport direction (TR1), and a second transport device (4) for feeding flat packaging materials (20) arranged in a first upright orientation (22sv1) in a second transport direction (TR2). The packaging system (1) comprises a handling device (5) for arranging the flat packaging materials (20) on the second transport device (4), and at least one displacement unit (8), configured to displace a plurality of upright packaging materials (20) relative to one another. The displacement unit (8) has vertically oriented side walls (9) and a support surface (10), wherein an angle differing from 90 degrees is formed between each of the side walls (9) and the support surface (10).

19 Claims, 8 Drawing Sheets

(58) Field of Classification Search
CPC ..... B65H 2701/176; B65H 2801/81; B65H 5/14; B31B 50/044; B31B 50/02; B65G 47/08; B65G 61/00; B65G 65/00
USPC ..... 414/796.5, 796.6; 198/418.4, 435, 456
See application file for complete search history.

(56) References Cited

U.S. PATENT DOCUMENTS

| | | | | |
|---|---|---|---|---|
| 10,689,205 | B2 * | 6/2020 | Iwasa | B65B 5/106 |
| 10,773,844 | B2 * | 9/2020 | Morino | B65H 1/027 |
| 2003/0120387 | A1 | 6/2003 | Sherwin | |
| 2010/0042254 | A1 | 2/2010 | Van Heek et al. | |
| 2012/0156001 | A1 * | 6/2012 | Monti | B65H 1/04 414/796.5 |
| 2017/0106532 | A1 | 4/2017 | Wellman et al. | |
| 2020/0338755 | A1 | 10/2020 | Behringer | |

FOREIGN PATENT DOCUMENTS

| | | | |
|---|---|---|---|
| EP | 1177980 | A2 | 2/2002 |
| EP | 2135826 | A1 | 12/2009 |
| WO | 2021043632 | A1 | 3/2021 |

OTHER PUBLICATIONS

Priority Application: DE 2022 104 177.8 Filed Feb. 22, 2022—German Search Report dated Nov. 18, 2022.
PCT Application: PCT/EP2022/087075 Filed Dec. 20, 2022: International Preliminary Report on Patentability dated Sep. 6, 2024.

* cited by examiner

PACKAGING SYSTEM AND METHOD FOR FEEDING FLAT PACKAGING MATERIALS TO A PACKAGING SYSTEM

CLAIM OF PRIORITY

The present application claims priority to International Application PCT/EP2022/087075, filed Dec. 20, 2022, which in turn claims priority to German Application 10 2022 104 177.8 filed Feb. 22, 2022, which are incorporated by reference.

FIELD OF THE INVENTION

The present invention relates to a packaging system and to a method for feeding flat packaging materials to a packaging system according to the features of the independent claims.

BACKGROUND OF THE INVENTION

The present invention relates to a transport device for flat cardboard blanks, in particular a transport device for feeding upright cardboard blanks lying adjacent to one another to a packaging module. A corresponding packaging module is in particular a folding module in which the cardboard blanks are pulled up and/or folded into the desired, in particular three-dimensional, shape. The cardboard packaging prepared in this way can then be filled with articles or the like, for example beverage containers, and assembled into larger packaging units on a pallet for subsequent transport.

Conventionally, the cardboard blanks are transported to the packaging module in an upright position on a transport device, in particular in such a way that the cardboard blanks are each arranged in a plane perpendicular to the transport direction of the transport device. In order to prevent the cardboard blanks, which are arranged substantially vertically or slightly inclined in or counter to the direction of transport, from tipping over, a stop bracket which can be moved at the end is attached to the transport device, for example, which must be retracted in order to load the transport device with new cardboard blanks.

In order to ensure safe feeding, a conveyor device is known according to the published, non-examined patent application DE 10 2006 038 656 A, which has belt links in ramp form which rise in the transport direction. This allows new cardboard blanks to be placed on the conveyor device and pushed against existing cardboard blanks, while at the same time ensuring that the cardboard blanks do not slide backward with their lower edge.

For reasons of space, it may be desirable or necessary to arrange a magazine or supply point for the cardboard blanks that are to be transported to the packaging module via the transport device not in line with the packaging module, but offset to the side. In this case, the transport device must be arranged diagonally between the magazine and the packaging module. In particular, in this case, a first transport direction for the cardboard blanks on the transport device is not aligned, but is formed at an obtuse angle to a transport direction for the cardboard blanks within the packaging module.

The problem is that when cardboard blanks are fed in at an angle, automated material supply is difficult and therefore such an inclined feed usually has to be filled manually. Another disadvantage is that the transport device for cardboard blanks, referred to as an inclined magazine, is usually arranged and/or designed at least partially below an article inlet. This arrangement results in limited accessibility of the transport device, which further complicates filling with cardboard blanks.

An arrangement in which flat packaging materials are fed to a packaging module via an inclined transport device is described in the published, non-examined patent application DE 10 2018 212 248 A1. Here, the packaging materials are moved along a profiled conveyor surface, by which profiles the packaging materials are oriented in such a way that the packaging materials enter the subsequent packaging module in a desired orientation, so that the packaging materials can be used directly in this module without first having to be brought into an orientation required for further processing by appropriate apparatuses.

The object of the invention is to eliminate the disadvantages of the known prior art and in particular to allow or improve the automation of the material supply of a packaging system with flat packaging materials.

The above object is achieved by a packaging system and a method for supplying flat packaging materials to a packaging system, which comprise the features in the independent claims. Further advantageous embodiments are described by the dependent claims.

SUMMARY OF THE INVENTION

The packaging system comprises a packaging module, a first transport device for feeding articles to the packaging module in a first transport direction and a second transport device for feeding flat, upright packaging materials in a second transport direction, which second transport direction differs from the first transport direction.

The flat packaging materials can be cardboard blanks in particular. The cardboard blanks may already be partially glued and prepared. In particular, the cardboard blanks can be made up of multiple layers. To fill them with articles, such as beverage containers, bottles, cans, etc., the cardboard blanks must be pulled up and/or unfolded into a three-dimensional shape in an appropriately configured handling module or packaging module.

The packaging module preferably comprises an unfolding device which pulls up and/or unfolds the supplied flat packaging materials into a three-dimensional shape. The unfolded packaging is then filled with at least one article, for example with beverage containers in the form of bottles or cans. The packaging material filled in this way can now preferably be closed, for example by applying an adhesive strip, gluing together partial regions of the packaging material, forming a latching connection between partial regions of the packaging material or the like.

When reference is made to an arrangement of the packaging materials, this means that the flat packaging materials stand upright on a side edge and are not transported lying on their flat surface. The term "upright position" includes both packaging materials which are positioned vertically on the second transport device and packaging materials which are inclined relative to a vertical plane. This may in particular be an inclination in which an upper edge of the packaging materials is arranged trailing in the transport direction in contrast to the side edge (i.e., the lower edge) of the packaging materials standing upright the transport device.

The packaging system further comprises a handling device for arranging the flat packaging materials on the second transport device and at least one displacement unit, which displacement unit is designed to displace a plurality of packaging materials that are each displaced in an upright position relative to one another. In particular, the displacement unit is designed to receive a packaging material stack and to displace the packaging materials within the packaging material stack relative to one another.

The at least one displacement unit is characterized by vertically oriented side walls and a support surface, wherein an angle differing from 90 degrees is formed between the side walls of the displacement unit and the support surface.

In particular, the displacement unit is formed by a type of box which is open at the top and which has a rectangular upper side in plan view and which has a support surface for the packaging material that is inclined relative to a horizontal plane.

The arrangement of a packaging material stack with packaging materials in an upright position within the displacement unit causes, due to the inclined support surface of the displacement unit, the packaging materials, in particular cardboard blanks, to slide downward due to the force of weight and thus to be displaced relative to one another within the upright packaging material stack.

The packaging materials are arranged in the displacement unit in such a way that the lower support edges of the packaging materials are oriented substantially orthogonally to the inclination of the support surface. In particular, the respective support edges of the individual packaging materials are arranged in different horizontal planes, the height of which depends on the position within the displacement unit. In particular, this results in a height offset between packaging materials that are in direct contact with one another, which height offset is preferably always the same. In particular, the upright packaging materials of a packaging material stack are placed in a regularly stepped position by the displacement unit The displacement of the packaging materials relative to one another is therefore to be understood in particular as a displacement of the packaging materials relative to one another parallel to their planar extension and with a downward directional component.

If necessary, vibrations, sliding elements acting from above, air flow or the like can be used to overcome the adhesive friction and support the displacement movement of the packaging materials relative to one another.

According to one embodiment, it can be provided that the displacement unit comprises additional devices for centering and/or orienting in order to adapt the displacement unit to a changed format for the packaging materials, for example in the event of a product change, for example if the packaging materials have a different size or if the packaging material stacks have a different height or width.

According to a preferred embodiment, the handling device is designed to position a stack of packaging materials arranged in a first upright orientation and offset from one another in a second upright orientation on the second transport device. In particular, the handling device removes a stack of packaging materials arranged offset from one another in a first orientation from a displacement unit and places this stack in the second upright position on the second transport device. In particular, the second orientation is characterized in that, compared to the first upright orientation, it is an orientation of the upright packaging material stack that is rotated 90 degrees relative to a surface normal of the packaging materials.

In particular, the packaging materials stand upright on a first side edge in the first upright orientation. In contrast, in the second upright orientation, the packaging materials stand upright on a second side edge, wherein the first side edge and the second side edge meet at a corner point. In particular, it is intended that the first side edge and the second side edge meet at a 90 degree angle.

In the method for supplying flat packaging materials to a packaging system, in particular a packaging system as described above, articles are supplied to the packaging module of the packaging system in a first transport direction via the first transport device and packaging materials are supplied in a second transport direction via the second transport device. Within the packaging module, a packaging material is unfolded and at least one article is arranged in the unfolded packaging material, thereby forming a packaging unit.

Within the scope of the method, it is provided that a plurality of packaging materials arranged in a first upright orientation are displaced relative to one another. If the packaging materials are provided, for example, as horizontal stacks, then a preceding method step can be provided in which the packaging materials are stacked in an upright position. The packaging materials forming a stack arranged in an upright position are displaced relative to one another, for example in the manner described above, by a displacement unit.

The packaging materials offset from one another are rotated 90 degrees relative to a surface normal of the packaging materials into a second upright orientation and arranged in this second upright orientation on the second transport device.

In particular, the first side edges or support edges located at the bottom in the first arrangement are vertically oriented after rotation. This means that the packaging materials within the packaging material stack are no longer offset upward or downward relative to one another, but are arranged laterally displaced relative to one another.

In other words, the handling device is designed to arrange the packaging materials on the second transport device in such a way that a surface normal of the packaging materials is arranged in a plane parallel to a vertical plane, which vertical plane comprises a third transport direction of the packaging materials within the packaging module.

In the packaging system, it is provided in particular that the supply of the packaging materials via the second transport device is configured to be oblique to the article supply via the first transport device. The further processing within the packaging module preferably takes place in a third transport direction, which is preferably designed parallel to or in particular aligned with the supply of the articles via the first transport device.

In particular, a first angle is formed between the second transport device and a third transport device of the packaging module, which first angle is greater than 90 degrees and less than 180 degrees, in particular which first angle is between 150 degrees and 175 degrees, particularly preferably which first angle is 165 degrees.

According to one embodiment, it is provided that packaging materials are arranged on the second transport device in such a way that a second angle is formed between a surface normal of the packaging materials arranged on the second transport device and the second transport direction, which second angle is smaller than 90 degrees and greater than 0 degrees, in particular which second angle is between 5 degrees and 30 degrees, particularly preferably which angle is 15 degrees.

Preferably, the sum of the measures of the first angle and the second angle is 180 degrees.

When the third transport device is positioned in alignment with the first transport device, a third angle is preferably formed between the first transport device and the second transport device, which results from the difference between 180 degrees and the first angle. Particularly preferred is an angular arrangement of the first transport device and the second transport device which forms a third angle of approximately 15 degrees.

A further embodiment of a packaging system provides for the provision of packaging blanks in a magazine, which magazine comprises a plurality of displacement units.

In particular, packaging materials are provided as upright packaging material stacks in the displacement units, wherein the packaging materials are arranged offset from one another within the displacement units in the manner already described.

The handling device removes a packaging material stack with packaging materials arranged offset from one another in the first orientation and arranges them on the second transport device with the rotation described above.

Alternatively, it can be provided that the handling device, for example, grasps a stack of packaging materials lying one on top of another, brings the stack of packaging materials into an upright position and inserts and releases it within a displacement unit.

For example, it can be provided that packaging materials are arranged in stacks in a magazine unit comprising one or more stack magazines. In the stack magazines, the packaging materials, which are removed from a pallet, for example, by a central handling unit, are preferably arranged in stacks, wherein the packaging materials are arranged in particular one above the other.

The stacks of packaging materials are arranged centrally in the stack magazine and are framed in particular by an enclosure, for example made of sheet metal or the like. This housing serves as a stop element when removing packaging materials from the stack magazine. The packaging materials are removed from a stack magazine as a packaging material stack by the handling device assigned to the second transport device, fed to a displacement unit and then positioned on the second transport device in an offset arrangement.

A further alternative embodiment can provide that a central handling unit, which central handling unit, for example, removes the packaging materials provided on a pallet in order to position them in the magazine, is assigned a displacement unit or an alternative apparatus for interleaving and orienting the packaging materials. This means that the handling unit can deposit the packaging materials that are already offset in a stack magazine of the magazine unit. The packaging materials, which are appropriately offset, are then removed from the stack magazine as a packaging material stack by the handling device and can be arranged directly on the second transport device.

The design of the displacement unit with an inclined support surface described above creates the offset between the packaging materials within the packaging material stack. This so-called offset stack can now be gripped again by the handling device, wherein the offset between the packaging materials remains. The offset stack is placed on the second transport device while rotating about a surface normal of the packaging materials, so that the offset is now characterized by a lateral displacement of the packaging materials relative to one another.

Other suitable apparatuses which are suitable for forming an interleaved or offset arrangement of the packaging materials are also to be covered by the application.

Preferably, such an alternative apparatus for forming the interleaved or offset arrangement of the cardboard blanks is also positioned directly on the second transport device or at least assigned to the second transport device. Alternatively, the apparatus can be assigned to the central handling unit or the handling device.

The handling device for handling the packaging material stacks can be formed, for example, by a robot, in particular an articulated arm robot.

Preferably, the handling device is equipped with a corresponding gripping element for gripping stacks of packaging material. The gripping element can be designed, for example, as a pincer gripper or the like.

According to one embodiment, the gripping element comprises, for example, two clamping jaws that can be moved toward one another. An alternative embodiment may provide that the gripping element comprises two clamping jaws, of which only one is adjustable or movable and can be moved toward the other clamping jaw or be distanced therefrom.

One embodiment may provide that the handling device is designed and equipped not just for handling the packaging materials. This is particularly possible because the handling device is not required permanently during the production process. Instead, the handling device can be used to supply other modules of the packaging system with consumable materials or the like as required during such so-called downtimes. For example, a movable handling device can be used to replenish film rolls on a film wrapping module or to replenish label rolls on a labeling module, etc.

In particular, the handling device can be movably arranged on a rail system, via which rail system the handling device can be moved to the respective modules. Alternatively, it can be provided that the handling device is arranged on a driverless transport system, whereby the flexibility of the application can be further increased, because the movement space of a driverless transport system is freely programmable and, in contrast to a rail system, is not limited to defined paths.

Furthermore, the transport surface of the second transport device can have an inclination with respect to a horizontal plane; in particular, it can be provided that the transport surface of the second transport device is designed to rise in the direction of the packaging module.

It should be expressly mentioned at this point that all aspects and embodiment variants which have been explained in connection with the apparatus according to the invention can also relate to, or be, partial aspects of the method according to the invention. Therefore, if the description or the claim definitions pertaining to the apparatus according to the invention make mention of certain aspects and/or correlations and/or effects, this applies equally to the method according to the invention. The same applies vice versa so that all aspects and embodiment variants which have been explained in connection with the method according to the invention can also relate to, or be, partial aspects of the apparatus according to the invention. Therefore, if the description or the claim definitions pertaining to the method according to the invention make mention of certain aspects and/or correlations and/or effects, this applies equally to the apparatus according to the invention.

BRIEF DESCRIPTION OF THE FIGURES

Exemplary embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

Figure 1:
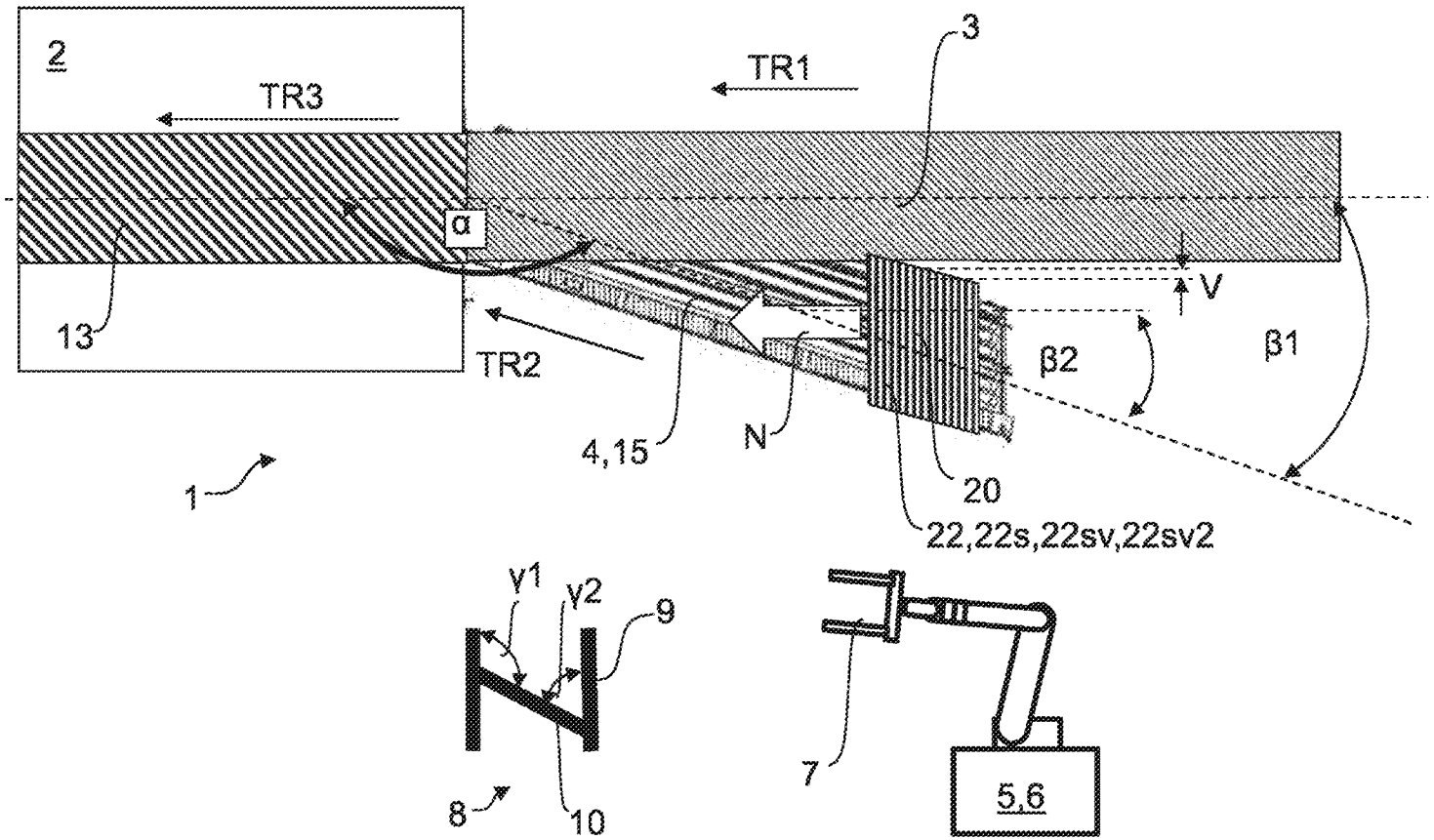
FIG. 1 shows a first embodiment of a packaging system.

Identical reference numerals are used for identical elements of the invention or those having the same effect. Furthermore, for the sake of clarity, only reference signs are shown in the individual figures, which are required for the description of the respective figure. The illustrated embodiments are merely examples of how the apparatus according to the invention or the method according to the invention can be configured, and they are non-limiting.

DETAILED DESCRIPTION OF THE INVENTION

The schematic representation of FIG. 1 shows a first embodiment of a packaging system 1, while FIG. 2A to 2G schematically illustrate the handling of the packaging materials 20 within the packaging system 1.

The packaging system 1 comprises a packaging module 2, a first transport device 3 for feeding articles to the packaging module 2 in a first transport direction TR1 and a second transport device 4 for feeding flat packaging materials 20 in a second transport direction TR2.

The flat packaging materials 20 can be, in particular, cardboard blanks 21. The cardboard blanks 21 may already be partially glued and prepared. In particular, the cardboard blanks 21 can be designed in multiple layers. To fill them with articles (not shown), such as beverage containers, bottles, cans, etc., the cardboard blanks 21 in the packaging module 2 must be pulled up and/or unfolded into a three-dimensional shape. This is done in particular in a conventionally known manner.

The supply of the packaging materials 20 via the second transport device 4 is configured to be at an angle to the article supply via the first transport device 3. Thus, the second transport direction TR2 differs from the first transport direction TR1. In particular, an angle β1 of, for example, approximately 15 degrees is formed between the first transport direction TR1 and the second transport direction TR2 or between the first transport device 3 and the second transport device 4.

The angular arrangement of the first transport device 3 and the second transport device 4 results in particular in the second transport device 4 being arranged at least partially below the first transport device 3. Furthermore, due to the further processing of the packaging materials 20 within the packaging module 2, special requirements arise for arranging packaging materials 20 on the second transport device 4 and are described in more detail below.

In particular, it is provided that the further processing of the packaging materials 20 within the packaging module 2, in particular the pulling up and/or unfolding of the flat packaging materials 20 and the filling of the unfolded packaging materials with at least one article each, takes place within the packaging module 2 in a third transport direction TR3. In particular, the third transport direction TR3 is aligned or parallel to the first transport direction TR1 of the article feed. Preferably, at least a third transport device 13 for the packaging materials 20 and/or the articles is provided within the packaging module 2

Accordingly, a first angle α is formed between the second transport direction TR2 and the third transport direction TR3 or between the second transport device 4 and the third transport device 13, which first angle α is greater than 90 degrees and less than 180 degrees, in particular which first angle α is between 150 degrees and 175 degrees, particularly preferably which first angle α is 165 degrees.

Preferably, the packaging materials 20 are arranged on the second transport device 4 such that a surface normal N of the packaging materials 20 is formed parallel to the third transport direction TR3. In particular, it is provided to arrange the packaging materials 20 on the second transport device 4 in such a way that a surface normal N is arranged in a plane or a plane parallel to a vertical plane when the packaging materials 20 enters or passes into the packaging module 2, which vertical plane comprises the third transport direction TR of the packaging materials 20 within the packaging module 2.

Preferably, the packaging materials 20 are arranged on the second transport device 4 in such a way that a second angle β2 is formed between the surface normal N of the packaging materials 20 and the second transport direction TR2, which second angle β2 in particular has the same angular measure as the angle β1.

Preferably, the sum of the measures of the first angle α and of the angle β1 or of the second angle β2 is 180 degrees.

The packaging module 2 preferably comprises an unfolding device which pulls up and/or unfolds the supplied flat packaging materials 20 into the three-dimensional shape. The unfolded packaging material 20 is then filled within the packaging module with at least one article, for example with beverage containers in the form of bottles or cans. The packaging material 20 filled in this way can now preferably be closed to form a finished packaging unit (not shown), for example by applying an adhesive strip, gluing together partial regions of the packaging material, forming a latching connection between partial regions of the packaging material 20, or the like.

When reference is made to an upright arrangement of the packaging materials 20 on the second transport device 4, this includes both packaging materials 20 which are positioned vertically on the second transport device 4 and packaging materials 20 which have an inclination relative to a vertical plane. This can in particular be an inclination in which an upper edge of the packaging materials 20 is arranged trailing in the transport direction TR2 compared to the lower edge of the packaging materials 20 standing upright on the second transport device 4.

The packaging system 1 further comprises a handling device 5 for arranging the flat packaging materials 20 on the second transport device 4. The handling device 5 can, for example, be an articulated arm robot 6, which is preferably equipped with a corresponding gripping element 7 for grasping stacks of packaging material 22 (see FIG. 2). According to one embodiment, the gripping element 7 is designed as a pincer gripper and comprises, for example, two clamping jaws 12 that can be moved relative to one another. A further embodiment can provide that the gripping element 7 comprises two clamping jaws, of which only one is designed to be movable and can be advanced toward the other clamping jaw or distanced therefrom.

Furthermore, the packaging system 1 comprises at least one displacement unit 8, which displacement unit 8 is designed to displace a plurality of upright packaging materials 20 relative to one another, which is shown and described in more detail below in connection with FIG. 2.

An embodiment of a displacement unit 8 is shown in FIGS. 1 and 2 in a side view. The displacement unit 8 is characterized by vertically oriented side walls 9 and a support surface 10, wherein an angle γ1, γ2 differing from 90 degrees is formed between each of the side walls 9 and the support surface 10. The sum of the angles γ1, γ2 is 180 degrees.

In particular, the displacement unit 8 is formed by a type of box which is open at the top (see in particular FIGS. 8 and 9), which box has a rectangular top side in plan view and which box has a support surface 10 for the packaging materials 20 which is formed obliquely with respect to a horizontal plane.

Figure 2A:
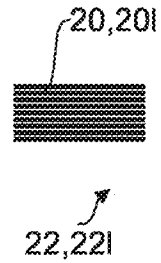
FIG. 2A to 2G schematically illustrate the handling of packaging materials within the packaging system.
Figure 2B:
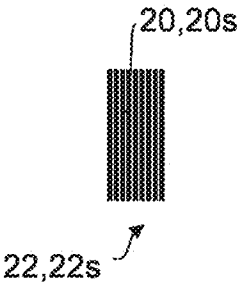
Figure 2C:
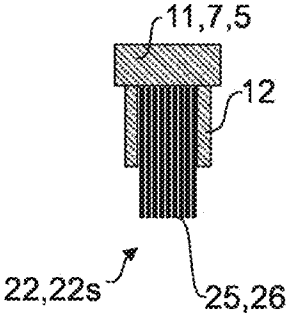

If the packaging materials 20 are provided horizontally in stacks (FIG. 2A, reference sign 201 for horizontal packaging materials and 221 for horizontal packaging material stacks), they must first be brought into an upright position by appropriate handling (FIG. 2B, reference sign 20*s* for upright packaging materials and 22*s* for upright packaging material stacks). For this purpose, the handling device 5 of the packaging system 1 (see FIG. 1) can be used or an independent suitable handling device is provided for this purpose (not shown).

Figure 2D:
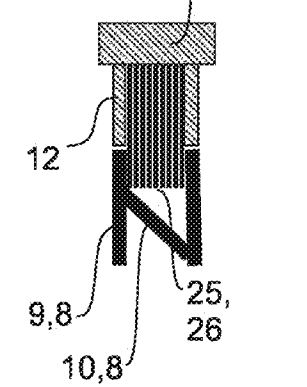
Figure 2E:
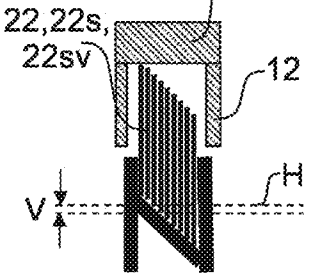
Figure 2F:
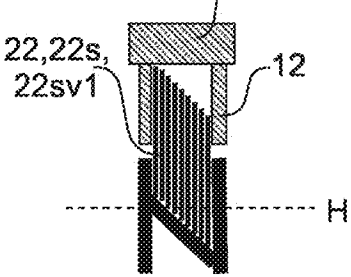

The upright packaging material stack 22*s* (FIG. 2B) is grasped by a suitable gripping device 11 (FIG. 2C) and inserted into the displacement unit 8 (FIG. 2D). For example, the gripping device 11 can be formed by the gripping element 7 of the handling device 5. However, an independent gripping device 11 can also be used.

In particular, the upright packaging material stack 22*s* is grasped by the gripping device 11 by holding the stack of packaging material 22*s* in a clamped manner, for example, between two clamping jaws 12 of the gripping device 11 which can be moved toward one another. The clamping jaws 12 engage in particular against the respective outward-facing surfaces of the packaging materials 20*s* which delimit the packaging material stack 22*s* on the outside.

After the packaging material stack 22*s* has been released within the displacement unit 8 (FIG. 2E), the inclined support surface 10 causes the packaging materials 20*s* to slide downward due to the force of weight and thus to be displaced relative to one another. In particular, the packaging stack 22*s* is released by opening the clamping jaws 12.

When inserted into the displacement unit 8, the packaging material stack 22*s* is arranged therein such that the lower support edges 25 of the packaging material 20*s*, which are also referred to as first side edges 26, are oriented substantially orthogonal to the inclination of the support surface 10. In this case, the respective support edges 25 of the individual packaging materials 20*s* are automatically arranged in different horizontals H, wherein the height of the respective horizontal H depends on the position of the particular packaging material 20*s* within the displacement unit 8.

In particular, this results in an offset V between packaging materials 20*s* which are in direct contact with one another, in particular a height offset, which offset is preferably always the same between adjacent packaging materials 20*s*. In particular, the uprightly arranged packaging materials 20*s* of a packaging material stack 22*s* are brought into a regularly offset or stepped first arrangement 22*sv*1 by the arrangement of the packaging material stack 22*s* in the displacement unit 8.

The displacement of the packaging materials 20*s* relative to one another is therefore to be understood in particular as a displacement of the packaging materials 20*s* relative to one another parallel to their planar extension, which displacement includes a downward directional component.

If required, vibrations, sliding elements acting from above, air flow or the like can be used in the case of packaging materials 20*s* that are stuck together in order to support the displacement movement of the packaging materials 20*s* relative to one another within the displacement unit 8.

Figure 2G:
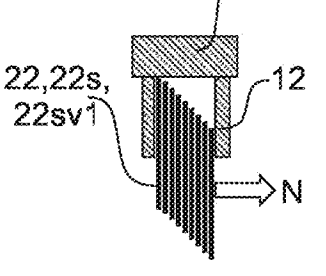

The packaging material stack 22*sv*1 thus formed with offset V is now grasped again, in particular by the gripping element 7 of the handling device 5. When the packaging material stack 22*sv* is grasped, the formed offset V is maintained (FIG. 2F) and the packaging material stack 22*sv*1 is fed for further handling (FIG. 2G). In particular, the packaging material stack 22*sv*1 formed with an offset V is arranged on the second transport device 4 while rotating about a surface normal N.

The rotation about the surface normal N results in the offset V of the packaging material stack 22*sv* no longer being vertically oriented. Instead, the packaging material stack 22*sv* arranged on the second transport device 4 now shows an offset V in horizontal extension. The packaging stack 22*sv* is therefore also marked with the reference sign 22*sv*2 (FIG. 1).

According to one embodiment, it can be provided that the displacement unit 8 is equipped with additional devices for centering and/or orienting (not shown) in order to adapt the displacement unit 8 to a changed format for the packaging materials 20, for example in the event of a product change, for example if the packaging materials 20 have a different size or if the packaging material stacks 22 have a different height or width.

The handling device 5 of the packaging system 1 is accordingly designed according to a preferred embodiment to arrange a packaging material stack 22*sv*1 of packaging materials 20*s* arranged in a first upright orientation and offset from one another in a second upright orientation 22*sv*2 on the second transport device 4. In particular, the handling device 5 removes a packaging material stack 22*sv*1 with packaging materials 20 arranged offset from one another from a displacement unit 8 and deposits this packaging material stack 22*sv*1 in the second upright position 22*sv*2 on the second transport device 4. In particular, the second orientation 22*sv*2 is characterized in that, compared to the first upright orientation 22*sv*1, it is an orientation rotated 90 degrees relative to a surface normal N of the packaging materials 20.

A support element can be provided on the gripping element 7, which support element ensures that the packaging materials 20 arranged in an offset arrangement remain in this offset arrangement within the packaging material stack 22*sv*. This support element can, for example, be automatically retracted after the packaging material stack 22*sv*2 has been deposited in the second orientation. In addition, the packaging materials 20 can be oriented against a stop element using a slider or the like integrated into the gripping element 7

In particular, the packaging materials 20 stands upright on a first side edge 26 in the first upright orientation 22*sv*1 and on a second side edge (not shown) in the second upright orientation 22*sv*2, wherein the first side edge 26 and the second side edge form a corner point of the packaging materials 20 at an intersection point. In particular, it is provided that the first side edge 26 and the second side edge form a 90 degree angle.

In particular, the first side edges 26 or support edges 25 located at the bottom in the first arrangement 22*sv*1 are vertically oriented after rotation about the surface normal N. This results in the packaging materials 20 within the stack 22*sv*2 no longer being offset upward or downward relative to one another, but being arranged laterally offset relative to one another.

In the following, the term inclined magazine 15 is also used as a synonym for the second transport device 4 for providing and feeding packaging materials 20 to the packaging module 2. The term inclined magazine 15 thus refers to a movable apparatus=(second transport device 4), via which the packaging materials 20 are fed to the packaging module 2 in the second transport direction TR2.

An embodiment of a system for the automated supply of the inclined magazine 15 with packaging materials 20, in particular with cardboard blanks 21, preferably comprises the following components: handling device 5 formed by a robot designed to be stationary on the inclined magazine 15 for arranging the cardboard blanks 21 in stacks in the inclined magazine 15, which robot is equipped with a corresponding gripping element 7.

Optionally, the gripping element 7 can have a separating unit for separating the cardboard blanks 21 when the cardboard blanks 21 are removed in stacks from a pallet.

Optionally, the displacement unit 8 for interleaving and orienting the cardboard blanks 21 or an alternative apparatus for interleaving the cardboard blanks 21 can be arranged and/or formed directly on the gripping element 7 of the handling device 5.

A further embodiment may provide that the displacement unit 8 or an alternative apparatus for the corresponding interleaving and orientation of the cardboard blanks 21 is arranged directly on the second transport device 4. The packaging material stacks 22 are then transferred uninterrupted by the handling device 5, in particular a robot or the like, to the displacement unit 8 or the alternative apparatus of the second transport device 4, and the cardboard blanks 21 are oriented or interleaved accordingly within the packaging material stack 22 and then guided directly further in the direction of the packaging module 2.

Figure 3:
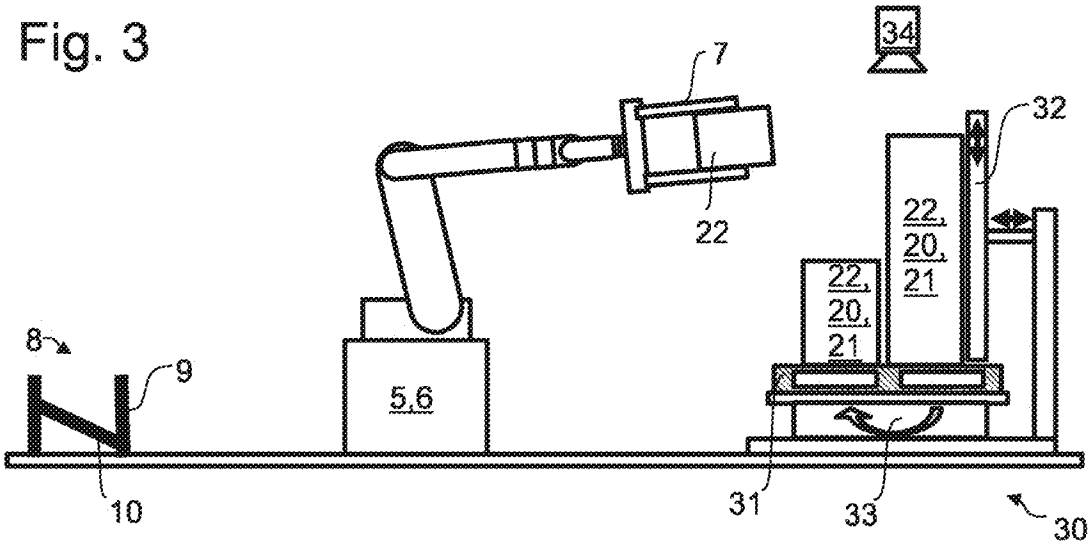
FIG. 3 shows the provision of packaging materials at a pallet placement location in a side view.
Figure 4:
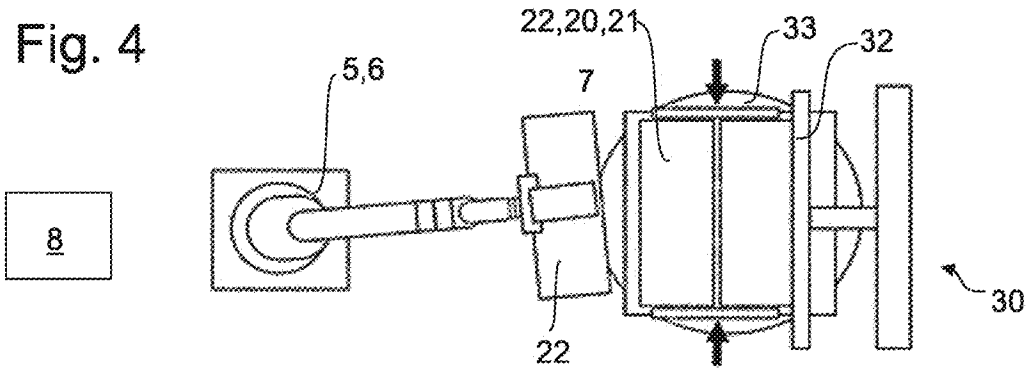
FIG. 4 shows the provision of packaging materials at a pallet placement location in a top view.

The cardboard blanks 21 can be made available at the location of the handling device 5, for example, via pallets 31, as shown in FIGS. 3 and 4. In particular, FIG. 3 shows the provision of packaging materials 20 at a pallet placement location 30 in a side view and FIG. 4 shows a view from above.

In addition to the handling device 5, a pallet placement location 30 is provided for the provision of the pallets 31 with packaging material stacks 22 arranged thereon. Preferably, the pallet placement location 30 is provided with a stop wall 32, in particular an adjustable one, for counter holding the packaging material 20 or cardboard blanks 21 when the packaging material stack 22 is picked up by the gripping element 7 of the handling device 5.

Optionally, a rotating device 33 can be provided at the pallet placement location 3. The rotating device 33 is designed in particular for rotation about a vertical axis of rotation in order to adapt the orientation of the pallet 31 to the handling device 5. Preferably, the pallet 31 is rotated such that the cardboard blanks 21 are preferably oriented transversely to their longitudinal direction with respect to the handling device 5.

Furthermore, a centering device for laterally centering the cardboard blanks 21 or packaging material stacks 22 on the pallet 31 may be present.

According to one embodiment, the pallet placement location 30 for the pallets 31 is stationary. In this case, the pallets 31 with the packaging material stacks 22 can be provided manually and/or automatically, for example manually by a pallet truck, industrial utility vehicle or forklift or automatically via a pallet conveyor, an automated guided vehicle system (AGV) or the like.

Alternatively, the pallets 31 with the packaging material stacks 22 could be delivered by a driverless transport system (not shown) and be placed directly thereon. In this case, it can be provided that the driverless transport system is equipped with a stop wall so that the pallet 31 can remain on it and so that the pallet 31 can be unloaded directly from the driverless transport system.

Furthermore, a sensor system 34 can be arranged on the handling device 5, in particular on the gripping element 7, or above the pallet placement location 30 in order to determine the exact position of the cardboard blanks 21 on the pallet 31. The sensor system 34 can be formed, for example, by a camera, a laser scanner, a feeler or the like.

Furthermore, the handling device 5 is assigned a displacement unit 8, as has been described in detail in particular in connection with FIG. 2.

The pallets 31 with the stacked cardboard blanks 21 can be checked and unpacked in a central handling unit (not shown). In the case of pallets 31 that have already been unpacked, hold-down devices from above and/or lateral centering devices can be used if necessary to stabilize the cardboard blanks 21 on the pallet 31 during transport to the inclined magazine 15.

Figure 5:
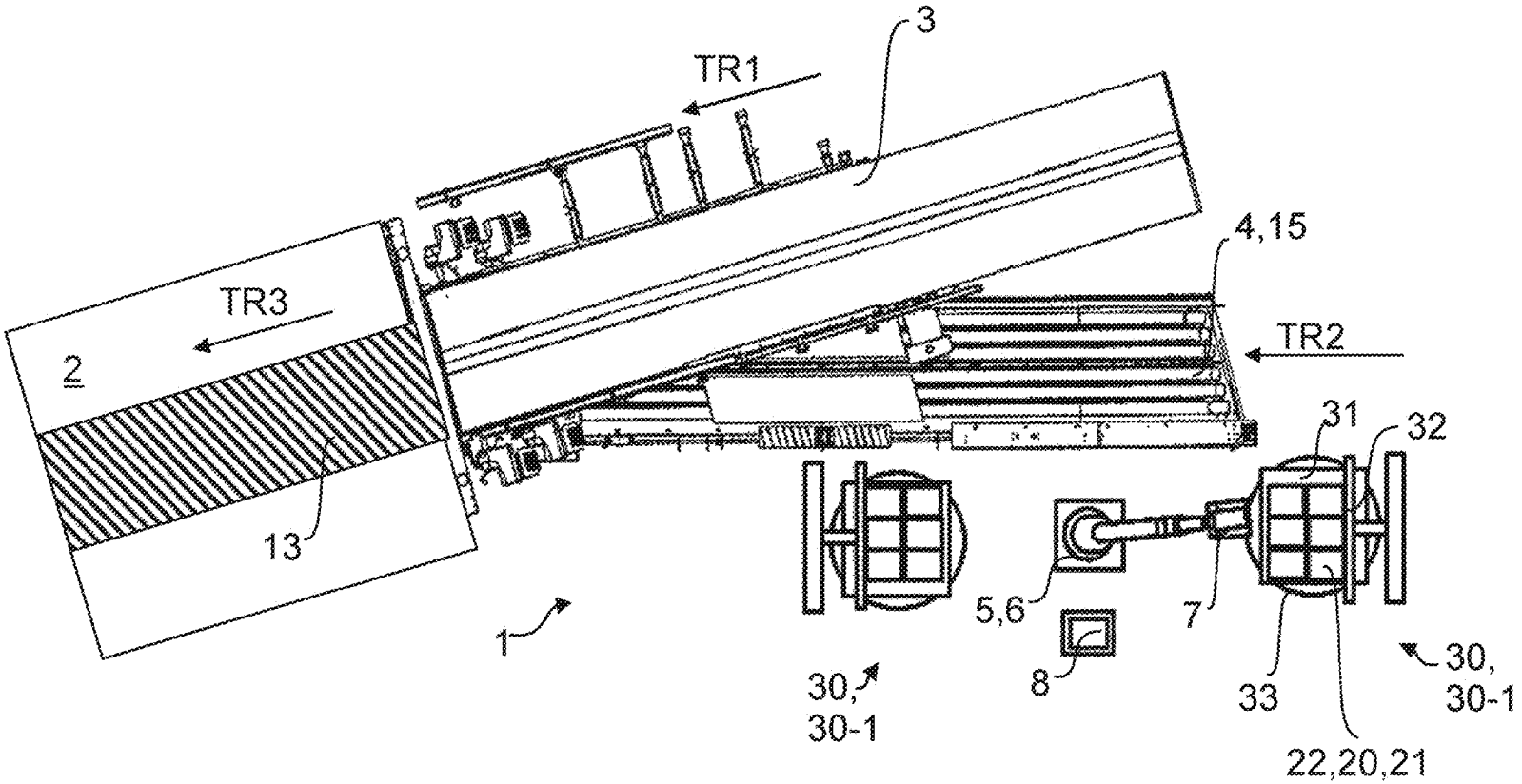
FIG. 5 shows a second embodiment of a packaging system.

FIG. 5 shows a second embodiment of a packaging system 1. In particular, the provision of the packaging materials 20 is provided at two pallet placement locations 30-1 and 30-2, which are located within reach of the handling device 5. In particular, the handling device 5 is arranged between the two pallet placement locations 30-1, 30-2 in such a way that the handling device 5 can receive packaging material stacks 22 from one of the two pallet placement locations 30-1, 30-2, depending on the availability. In addition, the range of the handling device 5 is sufficient for the handling device to be able to serve both the inclined magazine 15 and the displacement unit 8.

In particular, it is provided that the handling device 5 first picks up a packaging stack 22 made up of each of the packaging materials 20 provided at the first pallet placement location 30-1, brings it to the displacement unit 8 so that the offset V (compare FIGS. 1 and 2) can be produced and then arranges the offset packaging material stacks 22*sv* on the second transport device 4 while rotating them.

If the pallet 31 provided at the first pallet placement location 30-1 is empty, the handling device 5 now removes packaging material stacks 22 from the pallet 31 provided at the second pallet placement location 30-2. Meanwhile, the empty pallet 31 at the first pallet placement location 30-1 can be replaced by a new pallet 31, which new pallet 31 is supplied with packaging materials 20.

A plurality of pallet placement locations 30 offer the advantage that when changing pallets 31 from an empty pallet 31 to a pallet 31 loaded with cardboard blanks 21, a continuous supply of blanks can be ensured because the cardboard blanks 21 are removed from the other pallet 31 that has already been provided in the meantime. When changing types, for example, the next type of packaging material 20 can be prepared for a pallet placement location 30-1 while the currently processed type of packaging material 20 is still being removed from the pallet placement location 30-2.

If required, the range of the handling device 5 can be increased in all embodiments described above and those described below if it is configured to be movable. For example, it can be provided that the handling device 5 is arranged to be movable along the second transport device 4 on a linear axis or the like.

One embodiment may provide that the handling device 5 is designed and equipped not just for handling the cardboard blanks 21. In particular, the handling device 5 is not continuously required during the production process. Instead, the handling device can be used to supply other modules of the packaging system 1 with consumable materials as required during such so-called downtimes, for example, a movable handling device 5 can be used to replenish film rolls on a film wrapping module, or to replenish label rolls on a labeling module, etc.

In particular, the handling device 5 can be arranged on a rail system, via which the handling device 5 can be moved to the particular modules. Alternatively, it can be provided that the handling device is arranged on a driverless transport system, which can further increase the flexibility of the application, because the movement space, in contrast to a rail system, is not limited to defined paths.

Figure 6:
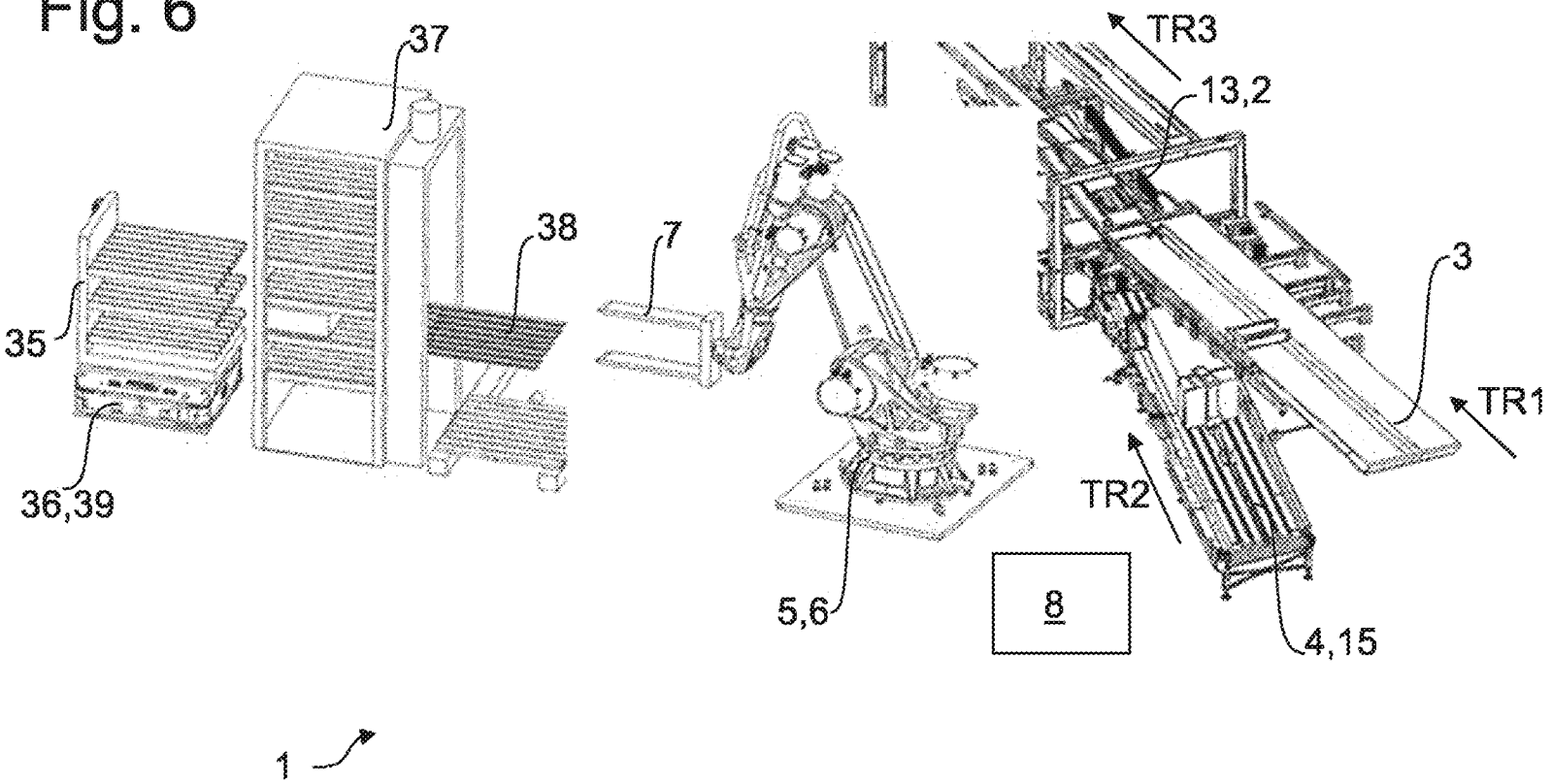
FIG. 6 shows a third embodiment of a packaging system.

FIG. 6 shows a third embodiment of a packaging system 1. Here, the stacked packaging materials (not shown) are provided in a magazine unit 35, which is arranged, for example, on a driverless transport system 36.

For example, packaging material stacks are removed from a pallet in a central handling unit (not shown) and transferred into the magazine unit 35. If required, it may also be useful for the packaging material stacks to be centered in a centering device, temporarily stored in a buffer device and transferred to the magazine unit 35 using a loading device.

The driverless transport system 36 serves to transport the magazine unit 35 stocked with stacks of cardboard blanks to the required position, which position is in particular adjacent to the second transport device 4 or inclined magazine 15. To pick up the magazine unit 35, the driverless transport system 36 is preferably equipped with a lifting device 39.

The complete loading of a magazine unit 35 with the packaging material stacks arranged therein can also optionally be transferred to a buffer device 37 arranged on the inclined magazine 15.

The packaging materials stacks are removed from the magazine unit 35 or the buffer device 37 using a fork lift 38 in order to be picked up by the gripping element 7 of the handling device 5, and before being transferred to and arranged in the inclined magazine 15, the packaging materials are offset relative to one another by the displacement unit 8.

Figure 7:
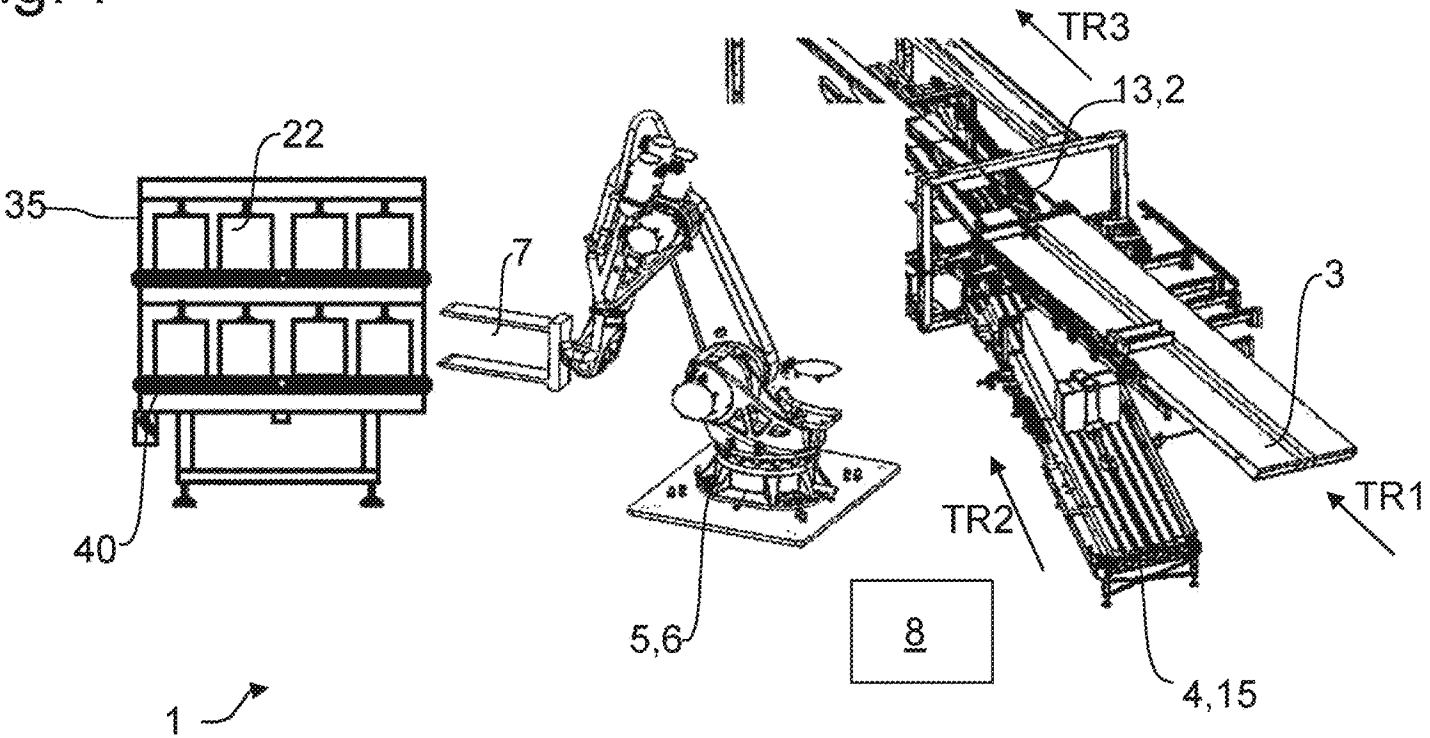
FIG. 7 shows a fourth embodiment of a packaging system.

FIG. 7 shows a fourth embodiment of a packaging system 1, in which the packaging materials are provided as a packaging material stack 22 on the inclined magazine 15 in a magazine unit 35 equipped with conveyor belts 40. Here, the magazine unit 35, for example, is equipped with split mat strips. With regard to the formation of the offset arrangement of the packaging materials within a removed packaging material stack 22 and the arrangement thereof on the second transport device 4 forming the inclined magazine 15, reference is made to the description of the previous figures.

Figure 9:
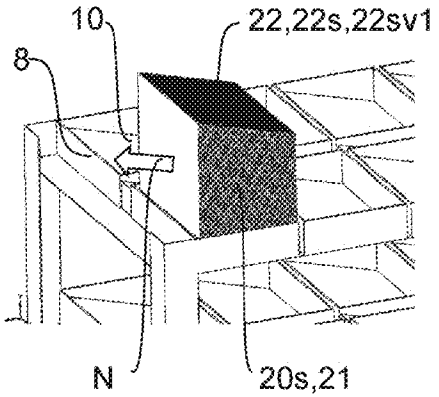
FIG. 9 shows an enlarged detail of a magazine unit shown in FIG. 8.
Figure 8:
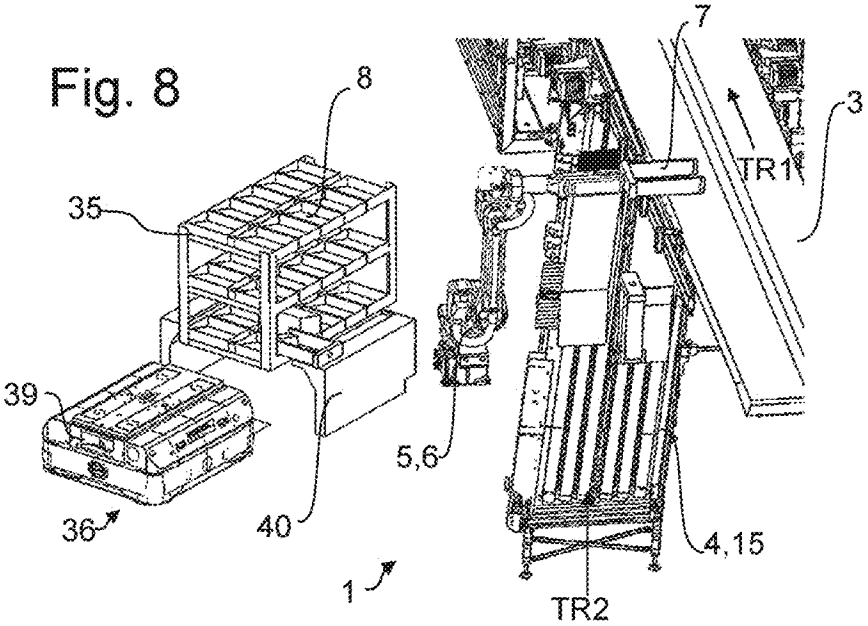
FIG. 8 shows a fifth embodiment of a packaging system.

FIG. 8 shows a fifth embodiment of a packaging system 1, in which packaging material stacks 22*s* with upright packaging materials 20*s* are provided in a magazine unit 35, and FIG. 9 shows an enlarged detail of a magazine unit 35 shown in FIG. 8.

The packaging materials 20 are, for example, introduced into the magazine unit 35 in a central handling unit (not shown) and arranged therein.

In particular, the magazine unit 35 shown in FIG. 8 is equipped with a plurality of displacement units 8. The packaging materials 20*s* are inserted in stacks directly into the displacement units 8 of the magazine unit 35, wherein the packaging materials 20 are arranged in an upright position within the packaging material stacks 22. Due to the obliquely formed support surface 10 of the displacement units 8, packaging material stacks 22*sv*1 are formed in which the packaging materials 20 are positioned in a vertically offset arrangement relative to one another.

In this context, particular reference is made to the description of FIG. 2, which describe in detail the production of the offset V based on the design of the displacement units 8.

The magazine unit 35 supplied with the packaging material stacks 22*sv*1 can now be brought to a supply point 41 by a driverless transport system 36 and arranged at the supply point 41 by a lifting device 39 assigned to the driverless transport system 36.

The offset packaging material stacks 22*sv*1 can be removed laterally from the magazine unit 35 by the gripping element 7 of the handling device 5 and arranged on the second transport device 4 of the inclined magazine 15 while rotating about a surface normal N.

In order to allow the removal of the packaging material stacks 22*sv*1 from the magazine unit 35 from both sides, a rotating apparatus can be integrated in the supply point 41.

An alternative embodiment (not shown) may provide for a magazine unit comprising one or more stack magazines. In the stack magazines, the cardboard blanks, which are taken from a pallet by a central handling unit, are preferably arranged in stacks such that the cardboard blanks are arranged one above the other.

The stacks of cardboard blanks are arranged centrally in the stack magazine and are framed in particular by a housing made of, for example, sheet metal or the like. This housing serves as a stop when packaging material stacks are removed by the handling device 5.

The cardboard blanks are removed from a stack magazine as a packaging material stack by the handling device 5 assigned to the second transport device 4, fed to a displacement unit 8 and then arranged on the second transport device 4 in an offset arrangement.

A further alternative embodiment (not shown) can provide that the central handling unit is assigned a displacement unit or an alternative apparatus for interleaving and orienting the cardboard blanks, so that the handling unit deposits the cardboard blanks already provided with an offset as a packaging material stack in a stack magazine of the magazine unit. The correspondingly offset packaging material stacks are then removed from the stack magazine by the handling device and arranged directly on the second transport device.

Figure 10:
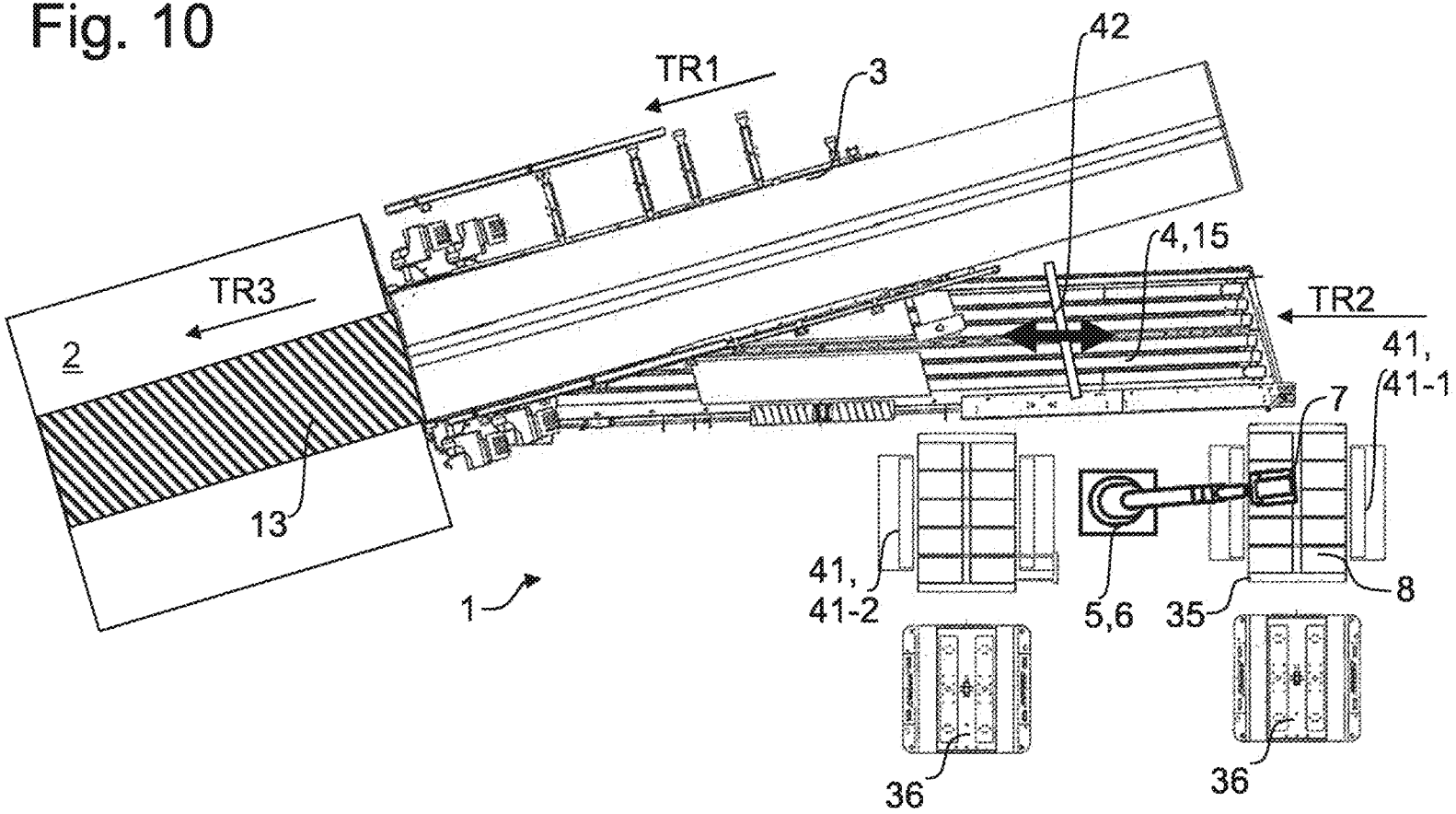
FIG. 10 shows a sixth embodiment of a packaging system.

FIG. 10 shows a sixth embodiment of a packaging system 1. Here, two supply points 41-1, 41-2 are provided for magazine units 35, which magazine units 35 are equipped in particular with displacement units 8 analogously to the embodiment described in FIGS. 8 and 9.

The inclined magazine 15 and at least one supply point 41 are located within reach of the particularly stationary handling device 5 with gripping element 7. A plurality of supply points 41 offers the advantage that when changing from one magazine unit 35 to a magazine unit 35 loaded with packaging material 20, a continuous supply of packaging material 20 can be ensured because the corresponding packaging material stacks 22 can be removed in the meantime from the other magazine unit 35 that has already been provided. When changing types, for example, the next type of packaging material 20 can already be prepared at the supply point 41-2, while the currently processed type of packaging material 20 is still being removed from the supply point 41-2.

In connection with the embodiments shown, in particular due to the restricted accessibility of the inclined magazine 15 and the limited range of the handling device 5, it can be provided that the inclined magazine 15 in the region below the first transport device 3 of the article inlet is assigned an adjusting bar 42 shown by example in FIG. 10. The adjusting bar 42 can be moved along the inclined magazine 15 toward the handling device 5 in order to facilitate filling and emptying of the entire inclined magazine 15.

For example, it is provided that in normal production operation the adjusting bar 42 and the second transport device 4 are preferably driven synchronously by servo drives. For the transmission of force, appropriate traction means, such as a toothed belt, chain or the like, or even a spindle drive can be used to move the adjusting bar 42.

The described embodiments allow the automated filling of an inclined magazine with packaging materials 20. The automation of the inclined magazine 15 described here also contributes to improving ergonomics when manually refilling and emptying the inclined magazine 15 if necessary. The operator no longer has to climb under the first transport device 3 of the article infeed, as was previously the case, in order to reach the cardboard blanks 21 at the front end of the inclined magazine 15.

It is also conceivable that the second transport device 4 for automated refilling is linearly connected to the packaging module 2 and is arranged below the first transport device 3. In this case, it is not necessary to offset the packaging materials within a packaging material stack, which simplifies the arrangement of the packaging materials on the second transport device 4.

Furthermore, it can be provided that the second transport device 4 is equipped with a stack support (not shown) mounted on rollers. The stack support can be moved in particular by a pneumatic cylinder. The pneumatic cylinder is preferably arranged on a holder which generates a feed force by resting on a chain track of the second transport device 4. Optionally, an additional load on the holder can increase the feed force.

It is also conceivable that the stack support is driven by an electric motor with a toothed belt, chain, spindle or the like.

In order to fill or refill the inclined magazine 15 or the second transport device 4 with packaging material, it can be provided that the packaging material stack 22 grasped by the gripping element 7, in particular the offset packaging material stack **22*sv*2 that is rotated about a surface normal N, is arranged adjacent to the stack end of the packaging material 20 already arranged on the second transport device 4**.

The gripping element 7 with the grasped packaging material stack **22*sv* tracks the stack end, which moves in the second transport direction TR2, by a tracking movement of the handling device 5**. This prevents packaging materials at the end of the stack from falling backward when the stack support is pulled back. The tracking movement is maintained throughout the entire process described below.

The stack support is retracted to form a gap for the arrangement of the packaging material stack **22*sv* grasped by the gripping element 7. The packaging material stack 22*sv* is now arranged on the second transport device 4 by the gripping element, in particular by lowering and opening the gripping element 7. If necessary, the gripping element 7** can be positioned at a suitable angle.

The gripping element 7 is then pulled upward so that the stack support can pass through underneath. The stack support is repositioned by extending the pneumatic cylinder. The holder is pushed backward along the chain track. Due to the frictional contact between the holder and the chain track, a force is exerted on the stack end.

In principle, it is conceivable that in order to empty the inclined magazine 15, e.g., when changing types, the packaging materials 20 are removed in stacks from the inclined magazine 15 using a gripper and placed on a pallet 31 or in a magazine unit 35 or in another buffer system in order to subsequently allow return transport to the central handling unit or to a warehouse. One embodiment provides that the handling device 5 is also used when emptying the inclined magazine 15.

One embodiment can provide that the cardboard blanks 21 arranged on the second transport device 4 are transported away from the packaging module 2 on the second transport device 4 counter to the second transport direction TR2, for example during a product change, with the aid of the adjusting bar 42 resting on the foremost cardboard blank 21. This can facilitate the removal of the cardboard blanks 21 and thus the emptying of the inclined magazine 15, because the cardboard blanks 21 can be transported to a region of the inclined magazine that is more easily accessible for the handling device 5, another removal apparatus, an operator or the like. In particular, the cardboard blanks 21 are transported for removal from the inclined magazine 15 into a region which can be reached, for example, by a handling device 5 having a limited range. Or the cardboard blanks 21 are transported to a region of the second transport device 4 which is not covered by the first transport device 4 and is therefore more easily accessible.

With the options described above, a fully automated blank supply for the inclined magazine 15 is possible. In principle, it is possible to design the system in such a way that when the type is changed, the packaging materials 20 still present in the inclined magazine 15 are automatically removed again and arranged in a magazine, warehouse or intermediate storage area of the packaging system 1 or fed to a central handling unit.

One or more magazine units 35 for packaging materials can be used, for example, to supply a plurality of packaging systems 1 together with a mobile handling device 5.

In conjunction with a stationary handling device 5, a high degree of automation in the supply of flat packaging materials 20 can be achieved.

The system can be flexibly expanded by adding further units, in particular magazine units 35 and/or handling devices 5.

The operator activities related to refilling packaging materials 20 are greatly reduced; remaining activities can be bundled in terms of both location and time.

Furthermore, the described system is characterized by an ergonomic improvement for the operator during manual refilling through partial or full automation of the inclined magazine 15, in particular through the movable adjusting bar 42 and/or the automated stack support.

The modular interchangeable system makes the entire system more flexible, redundant and cost-effective than previously known systems.

The embodiments, examples and variants of the preceding paragraphs, the claims or the following description and the figures, including their various views or respective individual features, may be used independently of one another or in any combination. Features described in connection with an embodiment are applicable for all embodiments provided the features are not incompatible.

Even if in the context of the above description of the figures reference is also generally made to "schematic" representations and views, this in no way means that the figure representations and their description are to be of subordinate importance with regard to the disclosure of the invention. A person skilled in the art is certainly able to derive sufficient information from the schematically and abstractly drawn representations, which will make it easier for him to understand the invention without being confused in any way by the drawn and possibly not exactly true-to-scale proportions of the packaging materials and/or parts of the packaging system or other drawn elements. The figures enable the person skilled in the art as reader to get a better understanding of the inventive idea, which has been formulated more generally and/or more abstractly in the claims and in the general part of the description, on the basis of the more specifically explained implementations of the method according to the invention and the more specifically explained mode of operation of the apparatus according to the invention.

The invention has been described with reference to a preferred embodiment. However, it is conceivable for a person skilled in the art that modifications or changes can be made to the invention without departing from the scope of protection of the following claims.

LIST OF REFERENCE SIGNS

1 packaging system
2 packaging module
3 first transport device
4 second transport device
5 handling device
6 articulated arm robots
7 gripping element
8 displacement unit
9 side wall
10 support surface
11 gripping device
12 clamping jaws
13 third transport device
15 inclined magazine
20 packaging materials
201 horizontal packaging materials
20*s* upright packaging material
21 cardboard blank
22 packaging material stack
221 horizontal packaging material stack
22*s* upright packaging material stack
22sv1 packaging material stack in regularly offset or stepped first orientation
22sv2 packaging material stack in regularly offset or stepped second orientation
25 support edge
26 first side edge
30 pallet placement location
30-1 first pallet placement location
30-2 second pallet placement location
31 pallet
32 stop wall
33 rotating device
34 sensor system
35 magazine unit
36 driverless transport system
37 buffer device
38 forklift
39 lifting device
40 conveyor belt
41 supply point
42 adjusting bar
α (first) angle
β1 (second) angle
β2 (second) angle
γ1 angle
γ2 angle
H horizontal
N surface normal
TR1 first transport direction
TR2 second transport direction
TR3 third transport direction
V offset

The invention claimed is:

1. A packaging system (1) comprising:
a packaging module (2),
a first transport device (3) for feeding articles to the packaging module (2) in a first transport direction (TR1),
and a second transport device (4) for feeding flat packaging materials (20) arranged in a first upright orientation (22*sv*1) in a second transport direction (TR2), where the second transport direction (TR2) differs from the first transport direction (TR1),
a handling device (5) for arranging the flat packaging materials (20) on the second transport device (4), and
at least one displacement unit (8) capable of displacing a plurality of upright packaging materials (20) relative to one another,
wherein the displacement unit (8) includes vertically oriented side walls (9) and a support surface (10), wherein an angle differing from 90 degrees is formed between each of the side walls (9) and the support surface (10).

2. The packaging system (1) of claim 1, wherein the handling device (5) is configured to offset a stack (22) of packaging materials (20) by arranging the stack (22) in the at least one displacement device (8) in a first upright orientation (22*sv*1) and then to arrange the stack (22) of offset packaging materials (20) in a second upright orientation (22*sv*2) on the second transport device (4), wherein the second upright orientation of the packaging materials (20) is rotated 90 degrees around a surface normal (N) of the packaging materials (20).

3. The packaging system (1) of claim 2, wherein the handling device (5) is configured to arrange the packaging materials (20) on the second transport device (4) such that the surface normal (N) of the packaging materials (20) is arranged in a plane parallel to a vertical plane, which vertical plane comprises a third transport direction (TR3) of the packaging materials (20) within the packaging module (2).

4. The packaging system (1) of claim 3, wherein a first angle (α) between the second transport device (4) and a third transport device (13) is greater than 90 degrees and less than 180 degrees.

5. The packaging system (1) of claim 4, wherein the first angle (α) is between 150 degrees and 175 degrees.

6. The packaging system (1) of claim 5, wherein the first angle (α) is 165 degrees.

7. The packaging system (1) of claim 4, wherein a second angle (β2) between the second transport direction (TR2) and the surface normal (N) of the packaging materials (20) arranged on the second transport device (4) is smaller than 90 degrees and greater than 0 degrees.

8. The packaging system (1) of claim 7, wherein the second angle (p2) is between 5 degrees and 30 degrees.

9. The packaging system (1) of claim 8, wherein the second angle (p2) is 15 degrees.

10. The packaging system (1) of claim 7, wherein the sum of the first angle (α) and the second angle (β2) is 180 degrees.

11. The packaging system (1) of claim 1, wherein further comprising a magazine (35) for packaging materials (20), wherein the magazine (35) comprises a plurality of displacement units (8).

12. The packaging system (1) of claim 1, wherein a transport surface of the second transport device (4) has an inclination with respect to a horizontal plane.

13. The packaging system (1) of claim 12, wherein the transport surface of the second transport device (4) is configured to rise in the direction of the packaging module (2).

14. A method for feeding flat packaging materials (20) to a packaging system (1), comprising:

arranging packaging materials (20) of a packaging material stack (22) in a first upright orientation (22*sv*1) and offsetting the packaging materials (20) from one another through the use of a displacement unit (8), whereupon rotating the offset packaging material stack (22) 90 degrees around a surface normal (N) of the packaging materials (20) into a second upright orientation (22*sv*2) and arranging the rotated packaging materials (20) on a second transport device (4), feeding articles to a packaging module (2) via a first transport device (3) in a first transport direction (TR1), feeding the offset and rotated packaging materials (20) to the packaging module (2) via the second transport device (4) in a second transport direction (TR2), unfolding the packaging materials (20) within the packaging module (2), and arranging at least one article in the unfolded packaging material (20) to form a packaging unit.

15. The method of claim 14, wherein the offset packaging materials (20) are arranged on the second transport device (4) such that a second angle (β2) between a surface normal (N) of the packaging materials (20) and the second transport direction (TR2) is smaller than 90 degrees and greater than 0 degrees.

16. The method of claim 15, wherein the offset packaging materials (20) are arranged on the second transport device (4) such that a surface normal (N) of the packaging materials and a third transport direction (TR3) are located within a vertical plane or within parallel vertical planes.

17. The method of claim 10, wherein the second angle (p2) is between 5 degrees and 30 degrees.

18. The method of claim 17, wherein the second angle (β2) is 15 degrees.

19. The method of claim 14, wherein a first angle (α) between the second transport device (4) and a third transport device (13) is greater than 90 degrees and less than 180 degrees.

* * * * *